US005564291A

United States Patent [19]

Tsai

[11] Patent Number: 5,564,291

[45] Date of Patent: Oct. 15, 1996

[54] ROUND KNITTING MACHINE SINKER WITH SCRAPER

[76] Inventor: Ji-Tsair Tsai, No. 8, Alley 7, La. Lih-Schirng, Jung-Jehng Road, Hsin Juang City, Taiwan

[21] Appl. No.: 439,347

[22] Filed: May 11, 1995

[51] Int. Cl.[6] ..... D04B 15/06

[52] U.S. Cl. ..... 66/104; 66/8; 66/168

[58] Field of Search ..... 66/8, 104, 105, 66/106, 107, 108 R, 108 A, 109, 110, 168

[56] References Cited

U.S. PATENT DOCUMENTS

| | | | |
|---|---|---|---|
| 4,164,856 | 8/1979 | Smith | 66/168 |
| 4,691,536 | 9/1987 | Yorisue et al. | 66/168 |
| 4,741,181 | 5/1988 | Plath | 66/168 |
| 5,201,793 | 4/1993 | Izumi et al. | 66/168 |

*Primary Examiner*—C. D. Crowder
*Assistant Examiner*—Larry D. Worrell, Jr.
*Attorney, Agent, or Firm*—Lowe, Price, LeBlanc & Becker

[57] ABSTRACT

A circular knitting machine sinker duct improvement apparatus to prevent lint accumulation. The apparatus comprises a multitude of flat, long, inter-alternated cleaning holes along the sinker ducts of the circular knitting machine. The front and two sides of the sinker plates include indented concave arches to form sharp edges, and one side of the sinker is adjacent to a high pressure air nozzle. The apparatus permits two actions by which accumulated lint is dispensed from the knitting machine, and avoids shutting down the knitting machine to clean lint. Additionally, when the knitting machine is stopped, the lint may be cleaned through cleaning holes without requiring disassembly of the knitting machine.

1 Claim, 3 Drawing Sheets

ROUND KNITTING MACHINE SINKER WITH SCRAPER

CIRCULAR KNITING MACHINE INVENTION

1. Field of the Invention

The present invention relates to a circular knitting machine sinker and, more particularly, to a device that is able to remove lint to maintain a smooth running knitting operation with minimum maintenance.

2. Description of the Prior Art

A known circular knitting machine, often operating with 100 or more spools is widely used for the mass production of knit fabric. During the knitting operation, lint and fiber is produced from fiber guide devices which disadvantageously float around in the air and attaches to inner and outer machine components. Over time, this lint and fiber will interfere with the normal operation of the machine by causing yarn breakage. This phenomenon is a problem in the industry.

In general, the knitting device of the circular knitting machine is most sensitive to lint accumulation, at the accumulated lint nearby the needle duct. A convex plate is positioned at the lower portion of the traditional sinker, and a matching duct is placed on the outer edge of the needle to prevent the sinker from floating and maintain normal function. The disadvantages of this design are numerous. For instance, when the sinker is pushed into the duct of the needle to make yarn form a loop, the sinker will not float, but lint will accumulate in the duct. Over time the lint will displace the convex plate underneath the sinker and prevent normal operation of the sinker. The fabric will have a rough surface and uneven eyelets. The yarn tends to break, resulting in failure of the knitting operation. To avoid these results, the lint has to be cleaned on the regular basis. Because of the structure of the traditional circular knitting machine, when cleaning occurs, the sinker, hook needle and triangular frame surrounding the needle portion have to be removed. Such disassembly and assembly of the device requires of even the most skillful operator one day to complete. This is not economically sound.

To overcome the above stated problems, the prior art, shown as FIG. 1, proposes multi-air holes (15) near the needle duct. A spray mouth is attached to spray air to prevent the lint from accumulating onto the convex duct (18) of the sinker (12), and blocking the movement of the sinker. This arrangement will extend the time period between cleanings to around 10 to 14 days, but does not completely eliminate the lint accumulation problem. Because the air holes are lined up within a set distance, and because the lint will intertwine, lint will begin to accumulate in the gap between air holes and block the movement o the sinker, resulting in loss of function of the air holes (15). Additionally, the design of air spray will give rise to another problem: that is, because the hooks and sinkers are placed all around the outer surface of the knitting machines, the air being blown out from the nozzles will result in the accumulation of lint on the hooks and sinkers, thus restricting movement of the hooks and sinkers on the track.

SUMMARY OF THE INVENTION

The purpose of the present invention is to provide a non blind spot circular sinker duct structure to prevent accumulation of lint, to make the knitting machine operate smoothly, to avoid constant cleaning, and to improve efficiency and maintain a high quality product.

Another purpose of the present invention is to offer a lint scrapable sinker design circular knitting sinker to clean the accumulated lint in the duct, to have the machine equipped with the function of preventing lint accumulation on the machine.

Another purpose of the present invention is to offer a manual cleaning structure, enabling an operator to clean the lint without disassembling all the sinkers' components. Thus saving maintenance hours and labor.

The features and advantages of the present invention will become apparent from the following description and the appended claims taken in conjunction with the accompanying drawings.

DETAILED DESCRIPTION OF THE INVENTION

Figure 1:
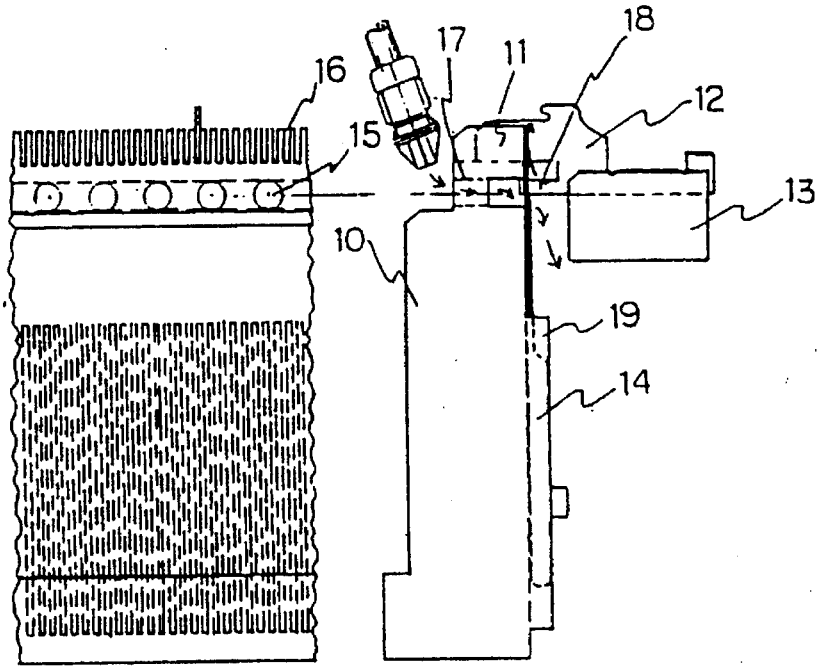
FIG. 1 (PRIOR ART)
FIG. 1 is a schematic view of the prior art structure.
Figure 4:
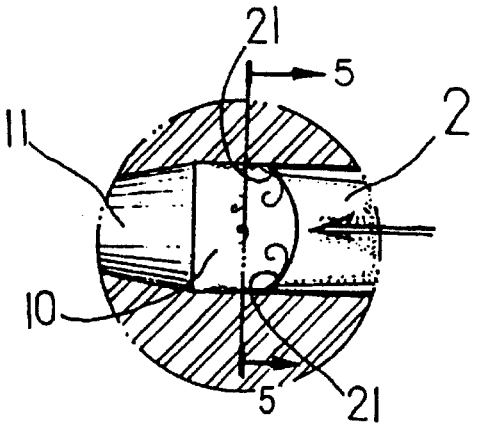
FIG. 4 is a detailed view taken along line 4 of FIG. 3 of the present invention to reveal the sinker plate in duct as it moves back and forth to clean the floss.
Figure 5:
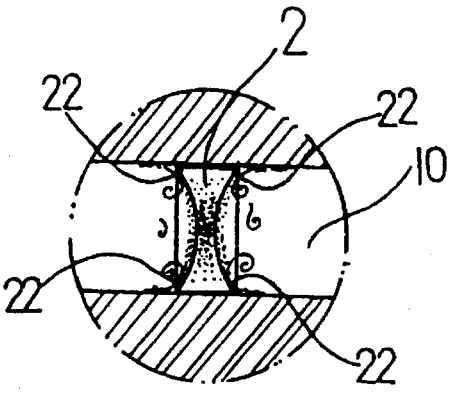
FIG. 5 is a front sectional view taken along lines 5—5 of FIG. 4 depicting the sinker plate in duct as it moves back and forth to clean the floss.
Figure 3:
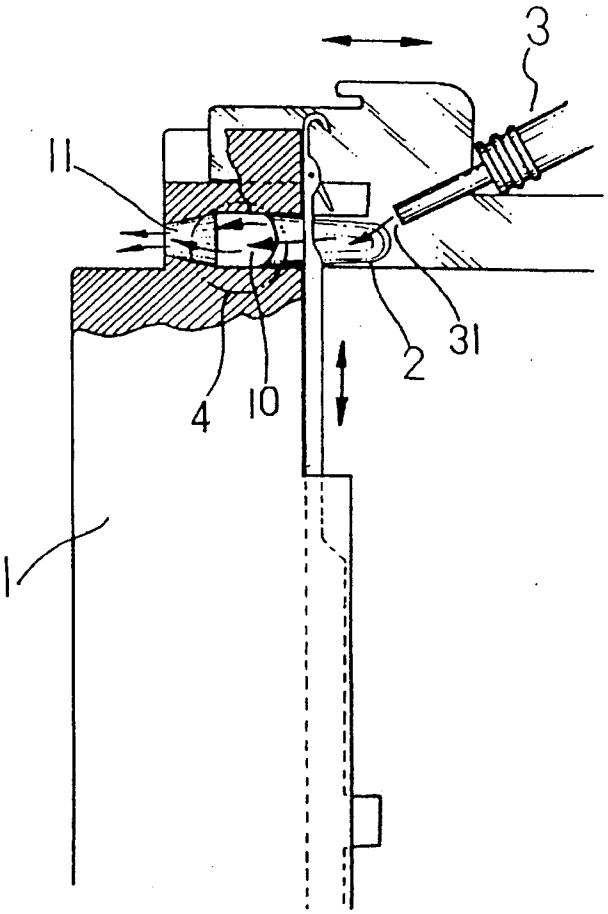
FIG. 3 is a partial side view of the structure of FIG. 2, depicting the movement of the components.
Figure 2:
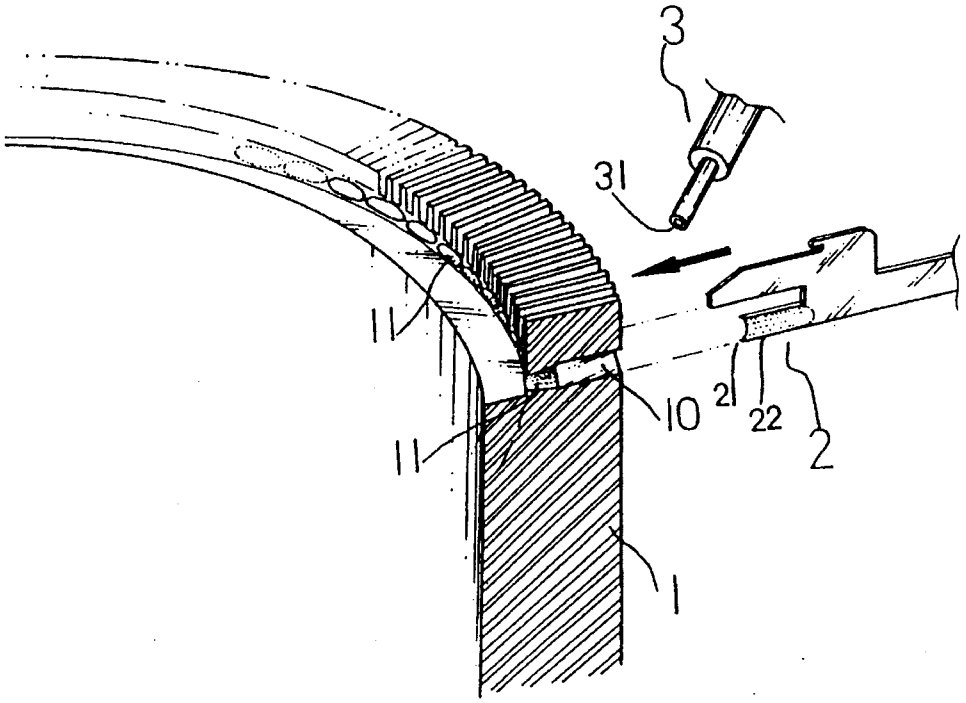
FIG. 2 is a perspective view of the structure of the present invention.
Figure 7:
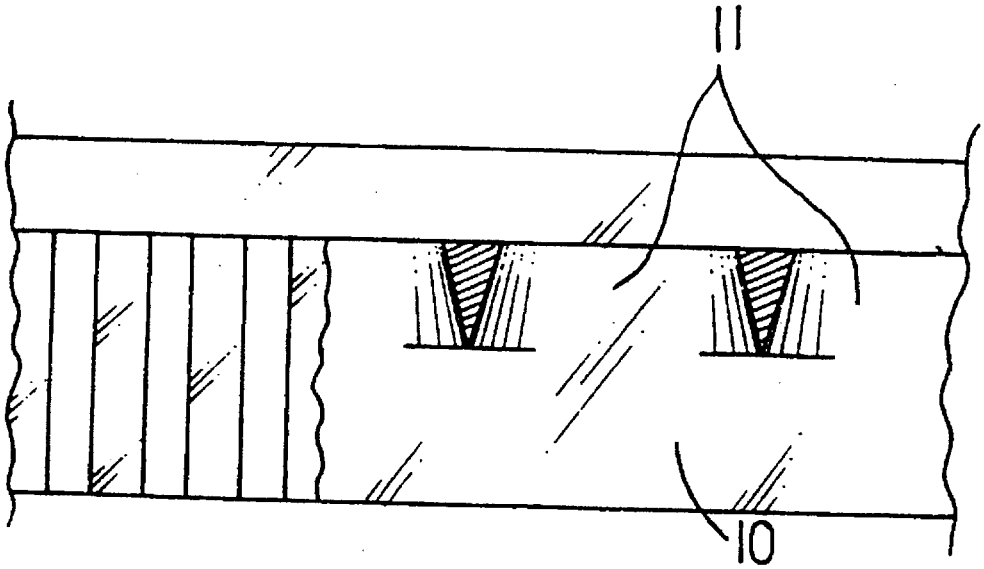
FIGS. 6 and 7 are top and front views of the duct cleaning hole of FIGS. 2–5.
Figure 6:
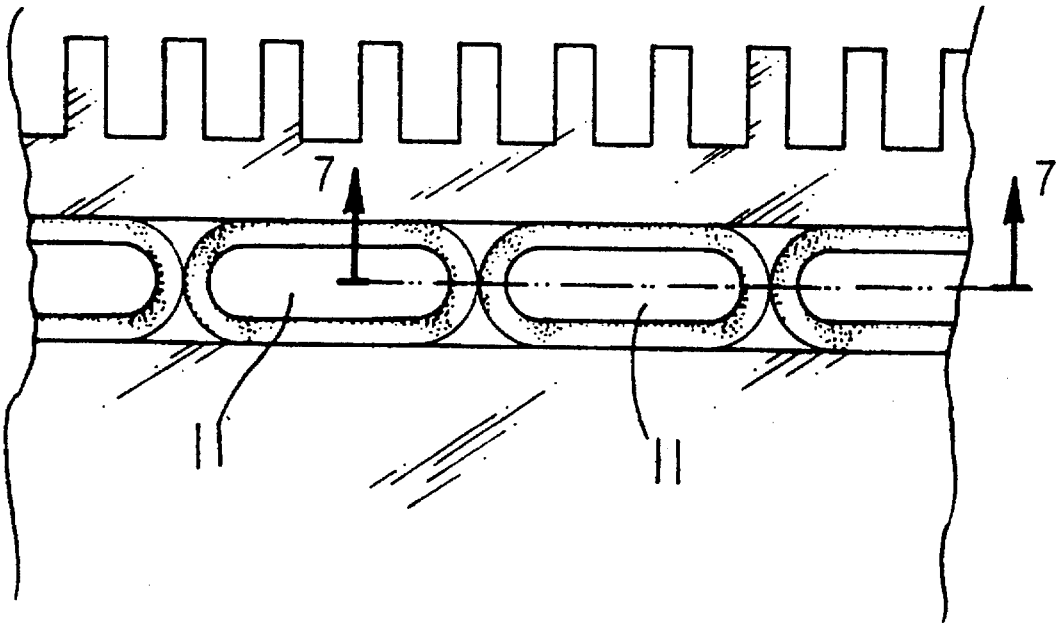

Referring to FIGS. 2, 3 and 6, flat, long shaped cleaning holes (11) are disposed along the circular sinker ducts (10) on the needle bed (1) of the knitting machine. Each cleaning hold (11) is cone shaped with the larger diameter of the hold linearly aligned to allow the indented arch shaped front edge of the sinker (2) to form a sharp scraper (21) (see FIG. 4). The two sides similarly include an indented arch so that the upper and lower ridges form sharp scraping edges (22) (shown as FIG. 5). A high pressured air nozzle (3) is placed at the one side of the sinker, with the nozzle mouth (31) positioned between the thin pieces (2) of the sinker to allow the high pressured air to blow to needle duct.

During operation, the sinker places its front edge (2) into the duct (10) of the needle by making front and rear movement. The high pressured air nozzle mouth (3) blows high pressured air through the two sides of the sinker plates (2), to allow the lint attached to the sinker plate (2) and needle duct (10) to be carried away by the high pressured air through cleaning hole (11). Because the cleaning holes (11) and the needle ducts are inter-alternated aligned to form the non-blind spot structure, when the high pressured air being blown through, most of the link in sinker plate (2) or needle duct (10) will be removed from the blind spot to ensure the function of cleaning; another the remaining lint will be scraped off by the scraping motion of the sinker plate (2), front scraper (21) and side scraper (22), and blown off by the high pressured air.

Although the above stated lint dispensing structure is quite satisfactory, some stubborn lint may stick to the ducts and is difficult to blow or scrape by the device. Thus, once the machine is stopped, the present invention may allow the floss to be scraped off by the application of the conventional front hooked thin rod (not shown in figures) being poked into the duct (10) through the cleaning holes (11), thereby permitting cleaning of the lint without disassembly.

Worthy of mentioning of the present invention is the flat, long oval shaped cleaning hole may also be designed as a flat rectangular shaped hole to allow elimination of the blind spots completely, thus preventing lint accumulation.

To summarize, the present invention offers a realistic, practical improvement with long history of practical testing and evaluation structure, to overcome the lint accumulation problem of the circular knitting machine's sinker ducts, thus saving maintenance cost and elevating production efficiency and quality.

Although the present invention has been described and depicted in detail, it is to be understood that the same is by way of illustration and example only and is not to be taken by way of limitation. The spirit and scope of the application being limited only by terms of the appended claims.

I claim:

1. An apparatus for preventing the accumulation of lint in a circular knitting machine, comprising:

a needle bed including a ring-shaped indented sinker duct, the sinker duct including a plurality of oval cone-shaped cleaning holes having a large diameter opening, the large diameter openings of the cleaning holes being aligned;

a sinker plate movable back and forth in the sinker duct of the needle bed, a front edge of the sinker plate being shaped as an indented convex arch with sharp edges on the upper and lower surfaces of the arch, the sinker plate including two sides also shaped as indented concave arches with sharp edges on upper and lower edges thereof;

a high pressurized air nozzle positioned near the sinker plate including a nozzle mouth adjacent to the sinker plate;

wherein when the sinker plate is moved back and forth in the sinker duct, the sharp edges on the indented convex arches of the sinker plate scrape the lint from the sinker duct, and the nozzle blows off the scraped lint.

* * * * *